US006000112A

United States Patent [19]

Öllinger et al.

[11] Patent Number: 6,000,112

[45] Date of Patent: Dec. 14, 1999

[54] APPARATUS FOR NEEDLING A WEB

[75] Inventors: Alois Öllinger, Leonding; Peter Schöffer, Pasching; Hannes Pum, Alberndorf, all of Austria

[73] Assignee: Textilmaschinenfabrik Dr. Ernst Fehrer Aktiengesellschaft, Leonding, Austria

[21] Appl. No.: 09/282,404

[22] Filed: Mar. 31, 1999

[30] Foreign Application Priority Data

Mar. 31, 1998 [AT] Austria ..... 562/98

[51] Int. Cl.[6] ..... D04H 18/00

[52] U.S. Cl. ..... 28/107; 28/114

[58] Field of Search ..... 28/107, 110, 111, 28/113, 114, 115; 112/80.4, 80.42

[56] References Cited

U.S. PATENT DOCUMENTS

| | | | |
|---|---|---|---|
| 3,845,529 | 11/1974 | Van Deusen et al. | 28/114 |
| 4,884,324 | 12/1989 | Stanislaw | 28/107 |
| 4,977,653 | 12/1990 | Pum | 28/115 |
| 5,153,970 | 10/1992 | Kunig | 28/107 |
| 5,287,604 | 2/1994 | Feyerl | 28/115 |
| 5,732,453 | 3/1998 | Dilo et al. | 28/114 |
| 5,873,152 | 2/1999 | Jourde et al. | 28/107 |

FOREIGN PATENT DOCUMENTS

| | | |
|---|---|---|
| 326 380 | 12/1975 | Austria . |
| 196 15 697 | 3/1997 | Germany . |
| 1 267 722 | 3/1972 | United Kingdom . |

*Primary Examiner*—Amy B. Vanatta
*Attorney, Agent, or Firm*—Collard & Roe, PC

[57] ABSTRACT

There is described an apparatus for needling a web, comprising at least one needle board (2) reciprocatingly movable in stitching direction of the needles via an eccentric drive (5), which needle board is reciprocatingly movable in direction of web movement (16) by means of an additional eccentric drive (15), which consists of two parallel eccentric shafts (17) which are movable in opposite directions and are provided with connecting rods (19). To create advantageous constructional conditions it is proposed that in a manner known per se the needle board (2) is articulated at the eccentric drive (5) for driving the needle board in stitching direction (4) of the needles via push rods (3) which are each movably mounted in a guiding sleeve (10), that the guiding sleeves (10) are pivotally mounted about an axis (12) extending parallel to the eccentric shafts (7, 17) and via a rigid guiding arm (21) are articulated at a coupler (20) connecting the connecting rods (19) of the two eccentric shafts (17) of the additional eccentric drive (15), and that the additional eccentric drive (15) has a means for adjusting the mutual phase position of the two eccentric shafts (17).

3 Claims, 2 Drawing Sheets

APPARATUS FOR NEEDLING A WEB

FIELD OF THE INVENTION

This invention relates to an apparatus for needling a web, comprising at least one needle board reciprocatingly movable in stitching direction of the needles by means of an eccentric drive, which needle board is reciprocatingly movable in the direction of web movement by means of an additional eccentric drive, which consists of two parallel eccentric shafts which are provided with connecting rods and are movable in opposite directions.

DESCRIPTION OF THE PRIOR ART

Since the web to be needled is retained with respect to the web feed during the needle impingement, the web can only make a feed movement with respect to the needles during the release of the web by the needles. To be able to increase the web feed between the needle impingements, it is known (DE 196 15 697 A1) to provide an additional reciprocating needle board drive in direction of web movement, so that the web feed is increased by the component of movement of the needle board in direction of web movement. This additional drive for the needle board is formed, like the main drive acting in stitching direction of the needles, by an eccentric drive, whose connecting rod is articulated at the needle bar carrying the needle board. An arrangement of two parallel eccentric shafts for the additional eccentric drive provides for a parallel guidance of the needle bar, because in this case the connecting rods form the guide rods of an articulated parallelogram. For adjusting the stroke of the additional eccentric drive for the reciprocating movement of the needle board in direction of web movement, the connecting rods may be supported on the eccentric shafts via adjusting eccentrics. For stroke adjustment, the adjusting eccentrics must therefore be rotated, which involves a change in the eccentricity of the eccentric drive. What is, however, disadvantageous in such a stroke adjustment is the fact that the rotary adjustment of the adjusting eccentrics is only possible in a complex way, because the adjusting eccentrics must be fixedly connected with the eccentric pins of the eccentric shafts in the respectively adjusted position. In addition, due to the guidance of the needle bar in stitching direction by the connecting rods of the additional eccentric drive, comparatively large lengths of the connecting rods are required, which prevent a common arrangement of the eccentric drives for the main drive and the additional drive in a common transmission housing.

It is therefore the object underlying the invention to provide an apparatus for needling a web as described above such that on the one hand there is ensured a simple stroke adjustment of the additional eccentric drive for the reciprocating movement of the needle board in direction of web movement, and on the other hand a space-saving construction can be ensured, which allows the arrangement of the eccentric drives for the main drive and the additional drive in a common transmission housing.

SUMMARY OF THE INVENTION

This object is solved by the invention in that in a manner known per se the needle board is articulated at the eccentric drive for driving the needle board in stitching direction of the needles via push rods which are each movably mounted in a guiding sleeve, that the guiding sleeves are pivotally mounted about an axis extending parallel to the eccentric shafts and via a rigid guiding arm are articulated at a coupler connecting the connecting rods of the two eccentric shafts of the additional eccentric drive, and that the additional eccentric drive has a means for adjusting the mutual phase position of the two eccentric shafts.

Since the needle board is driven in stitching direction of the needles via push rods movably mounted in guiding sleeves, the guidance of the needle board in stitching direction of the needles becomes independent of the length of the connecting rods of the additional eccentric drive for driving the needle board in direction of web movement. However, such guidance of the needle board requires a pivotal mounting of the guiding sleeves about a swivel axis parallel to the eccentric shafts. The drive connection between the guiding sleeves and the additional eccentric drive is effected via a guiding arm rigidly connected with the guiding sleeves, which guiding arm is articulated at a coupler connecting pairs of the connecting rods of the two eccentric shafts of the additional eccentric drive. Since the stroke of the point of articulation of the guiding arms at the couplers connecting the connecting rods depends on the coupling movement and thus on the mutual phase position of the two eccentric shafts with given eccentricities, the swivel stroke for the guiding sleeves can easily be adjusted by a means for adjusting the mutual phase position of the two eccentric shafts. The connecting rods connected in pairs by means of couplers can be kept very short, so that the accommodation of the additional eccentric drive for driving the needle board in direction of web movement in a common housing creates no difficulties. The guiding sleeves can simply be rigidly connected with each other inside the housing, in order to obtain a rigid enough construction.

To obtain a compact drive unit with a low overall height, there may be employed, in accordance with a further embodiment of the invention, an apparatus with an eccentric drive provided for driving the needle board in stitching direction of the needles, which eccentric drive consists of two parallel eccentric shafts which are provided with connecting rods and are movable in opposite directions. The essential aspect is that the connecting rods arranged on the side of the eccentric shafts facing away from the needle board are connected in pairs with a coupler, in which engage the push rods guided between the two eccentric shafts, and that the swivel axis of the guiding sleeves extends in the vicinity of the common axial plane of the eccentric shafts. As a result of these measures, the overall height is substantially determined by the length of the connecting rod of the main drive, because the push rods of the couplers connecting the connecting rods extend towards the eccentric shafts between the same. The arrangement of the swivel axis of the guiding sleeves accommodating the push rods in the vicinity of the common axial plane of the eccentric shafts of the main drive involves advantageous conditions for the necessary mass balance.

BRIEF DESCRIPTION OF THE DRAWING

In the drawing, the subject-matter of the invention is represented by way of example, wherein.

DESCRIPTION OF THE PREFERRED EMBODIMENT

Figure 1:
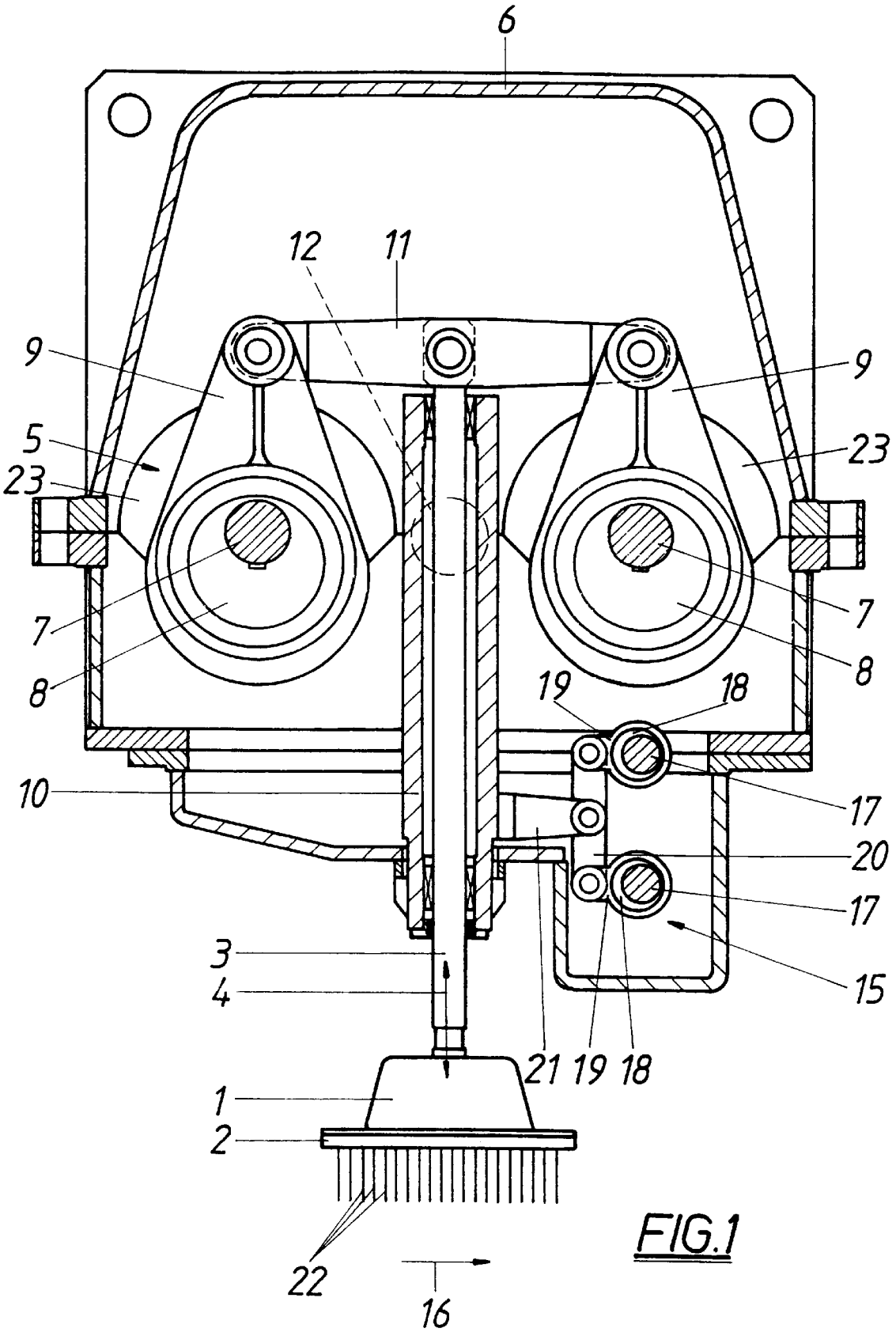
FIG. 1 shows segments of an inventive apparatus for needling a web in the vicinity of the eccentric drives in a simplified section vertical to the eccentric shafts.
Figure 2:
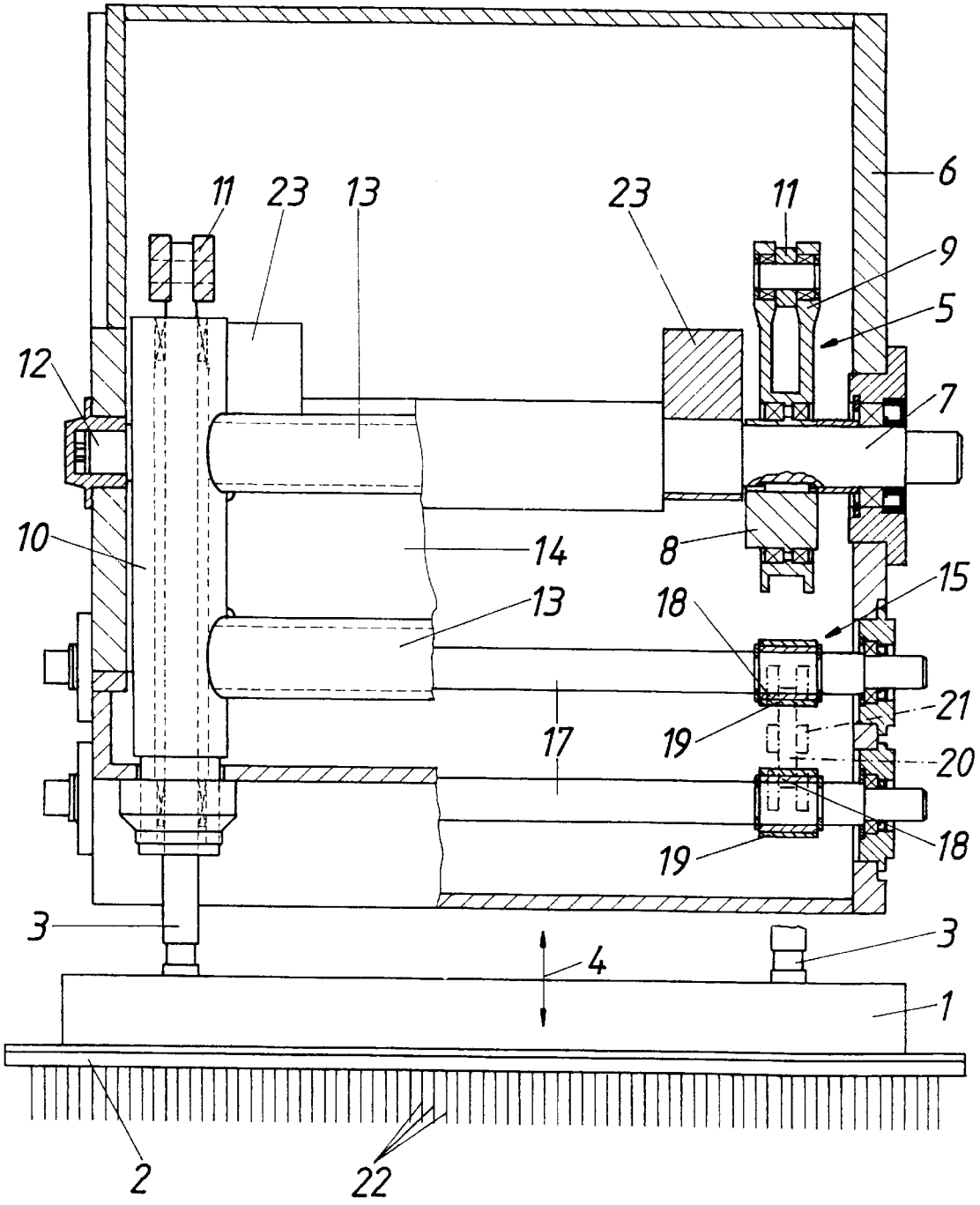
FIG. 2 shows this apparatus in a section parallel to the eccentric shafts.

The represented apparatus for needling a web has a needle board 2 disposed on a needle bar 1, which needle board is reciprocatingly movable via push rods 3 in stitching direction 4 of the needles, namely via an eccentric drive 5 which consists of two eccentric shafts 7 rotatably mounted in a housing 6, where connecting rods 9 are mounted on the eccentrics 8 of said eccentric shafts. The push rods 3, which are guided so as to be axially movable in guiding sleeves 10, engage in the connecting rods 9 of the couplers 11 connecting the two eccentric shafts, where the arrangement has been made such that the couplers 11 are provided on the side of the eccentric shafts 7 facing away from the needle board 2. Accordingly, the guiding sleeves 10 with the push rods 3 extend between the two eccentric shafts 7, as this can be taken in particular from FIG. 1.

In contrast to conventional push rod guiding systems, the guiding sleeves 10 of the inventive apparatus are pivotally mounted in the housing 6 about a swivel axis 12 parallel to the eccentric shafts 7. The guiding sleeves 10 form a rigid constructional unit, which is obtained by connecting tubes 13 and a web plate 14 between these connecting tubes 13. By means of an additional eccentric drive 15, the constructional unit formed by the guiding sleeves 10 can reciprocatingly be swivelled about the swivel axis 12 in direction of web movement 16 (FIG. 1). For this purpose, the eccentric drive 15 has two parallel eccentric shafts 17, whose eccentrics 18 carry connecting rods 19, which are connected in pairs by a coupler 20. Since a guiding arm 21 rigidly connected with the respective guiding sleeve 10 engages in the coupler 20, the guiding sleeves 10 are reciprocated by the eccentric drive 15. In the case of a corresponding synchronization of the eccentric drives 5 and 15, the needles 22 of the needle board 2 are thus moved into the web in direction of web movement 16 during the needle impingement, in order to be moved back into the stitching position upon release of the web against the direction of web movement 16. By means of a known means for adjusting the mutual phase position of the two eccentric shafts 17, which is not represented in detail, the stroke of the eccentric drive 15 can easily be adjusted corresponding to the respective requirements, as this can directly be taken from FIG. 1.

The eccentric shafts 7 and 17 of the eccentric drives 5 and 15, respectively, rotate in opposite directions due to the necessary mass balance. The additional counterbalance weights for the needle bar 1 and the needle board 2 are designated with 23. To create advantageous conditions for the mass balance required as a result of the additional eccentric drive, the swivel axis 12 lies in a common axial plane with the eccentric shafts 7 of the eccentric drive 5.

We claim:

1. An apparatus for needling a web, comprising at least one needle board reciprocatingly movable in a stitching direction of the needles, said needle board being reciprocatingly movable in a direction of web movement by means of a first eccentric drive, said first eccentric drive comprising two parallel eccentric shafts having connecting rods and being movable in opposite directions, further comprising push rods which articulate the needle board at the first eccentric drive for driving the needle board in a stitching direction of the needles, each push rod being movably mounted in a guiding sleeve, the guiding sleeves being pivotally mounted about an axis extending parallel to the eccentric shafts and being articulated by a rigid guiding arm at a coupler connecting the connecting rods of the two eccentric shafts of the first eccentric drive, and the first eccentric drive comprising a means for adjusting the mutual phase position of the two eccentric shafts.

2. The apparatus as claimed in claim 1, wherein the guiding sleeves are rigidly connected with each other.

3. The apparatus as claimed in claim 1, comprising a second eccentric drive for driving the needle board in the stitching direction of the needles, said second eccentric drive comprising two parallel eccentric shafts having connecting rods and being movable in opposite directions, further comprising a coupler which connects in pairs the connecting rods disposed on a side of the eccentric shafts facing away from the needle board, the push rods guided between the two eccentric shafts engaging in the coupler, and wherein the axis of the guiding sleeves extends in the vicinity of a common axial plane of the eccentric shafts.

* * * * *